US008340547B2

(12) United States Patent
Kobayashi et al.

(10) Patent No.: US 8,340,547 B2
(45) Date of Patent: Dec. 25, 2012

(54) CLEANING DEVICE, IMAGE FORMING APPARATUS INCLUDING THE SAME AND CLEANING METHOD

(75) Inventors: Takuya Kobayashi, Kanagawa (JP); Shigeru Morimoto, Kanagawa (JP); Hideyuki Ohtani, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 47 days.

(21) Appl. No.: 13/032,147

(22) Filed: Feb. 22, 2011

(65) Prior Publication Data

US 2012/0014710 A1 Jan. 19, 2012

(30) Foreign Application Priority Data

Jul. 13, 2010 (JP) ..... 2010-158623

(51) Int. Cl.
*G03G 15/16* (2006.01)
*G03G 21/00* (2006.01)

(52) U.S. Cl. ..... 399/101; 399/358

(58) Field of Classification Search ..... 399/99, 399/101, 102, 350, 358
See application file for complete search history.

(56) References Cited

U.S. PATENT DOCUMENTS

| | | | | |
|---|---|---|---|---|
| 7,764,918 | B2 * | 7/2010 | Kawagoe | 399/350 |
| 7,860,430 | B2 * | 12/2010 | Saka | 399/101 |
| 8,023,857 | B2 * | 9/2011 | Saka | 399/101 |
| 8,103,185 | B2 * | 1/2012 | Chiba et al. | 399/101 |

FOREIGN PATENT DOCUMENTS

| | | | |
|---|---|---|---|
| JP | 2002-169442 | A | 6/2002 |
| JP | 2009-128415 | A | 6/2009 |

* cited by examiner

*Primary Examiner* — Robert Beatty
(74) *Attorney, Agent, or Firm* — Sughrue Mion, PLLC

(57) ABSTRACT

A cleaning device includes a cleaning member that comes into contact with a developer carrier, which carries developer, in a direction crossing a moving direction of the developer carrier and cleans the developer carrier by removing the developer from the developer carrier, a recovery section that is provided with a recovery port formed inside of end portions of the developer carrier in the direction crossing the moving direction of the developer carrier and recovers the developer, which is removed by the cleaning member, through the recovery port, and a guide member that guides the developer to the recovery port, one end of the guide member being positioned outside an end portion of the cleaning member and the end portion of the developer carrier, and the other end of the guide member being positioned inside the cleaning member in the direction crossing the moving direction of the developer carrier.

11 Claims, 5 Drawing Sheets

CLEANING DEVICE, IMAGE FORMING APPARATUS INCLUDING THE SAME AND CLEANING METHOD

CROSS-REFERENCE TO RELATED APPLICATION

This application is based on and claims priority under 35 U.S.C. 119 from Japanese Patent Application No. 2010-158623 filed on Jul. 13, 2010.

BACKGROUND

Technical Field

The present invention relates to a cleaning device, an image forming apparatus including the same and a cleaning method.

SUMMARY

According to an aspect of the invention, there is provided a cleaning device including a cleaning member that comes into contact with a developer carrier, which carries developer, in a direction crossing a moving direction of the developer carrier and cleans the developer carrier by removing the developer from the developer carrier; a recovery section that is provided with a recovery port formed inside of end portions of the developer carrier in the direction crossing the moving direction of the developer carrier and recovers the developer, which is removed by the cleaning member, through the recovery port; and a guide member that guides the developer to the recovery port, one end of the guide member being positioned outside an end portion of the cleaning member and the end portion of the developer carrier, and the other end of the guide member being positioned inside the cleaning member in the direction crossing the moving direction of the developer carrier.

BRIEF DESCRIPTION OF THE DRAWINGS

Exemplary embodiments of the present invention will be described in detail based on the following figures, wherein.

DETAILED DESCRIPTION

Exemplary embodiments of the invention will be described below with reference to drawings.

Figure 1:
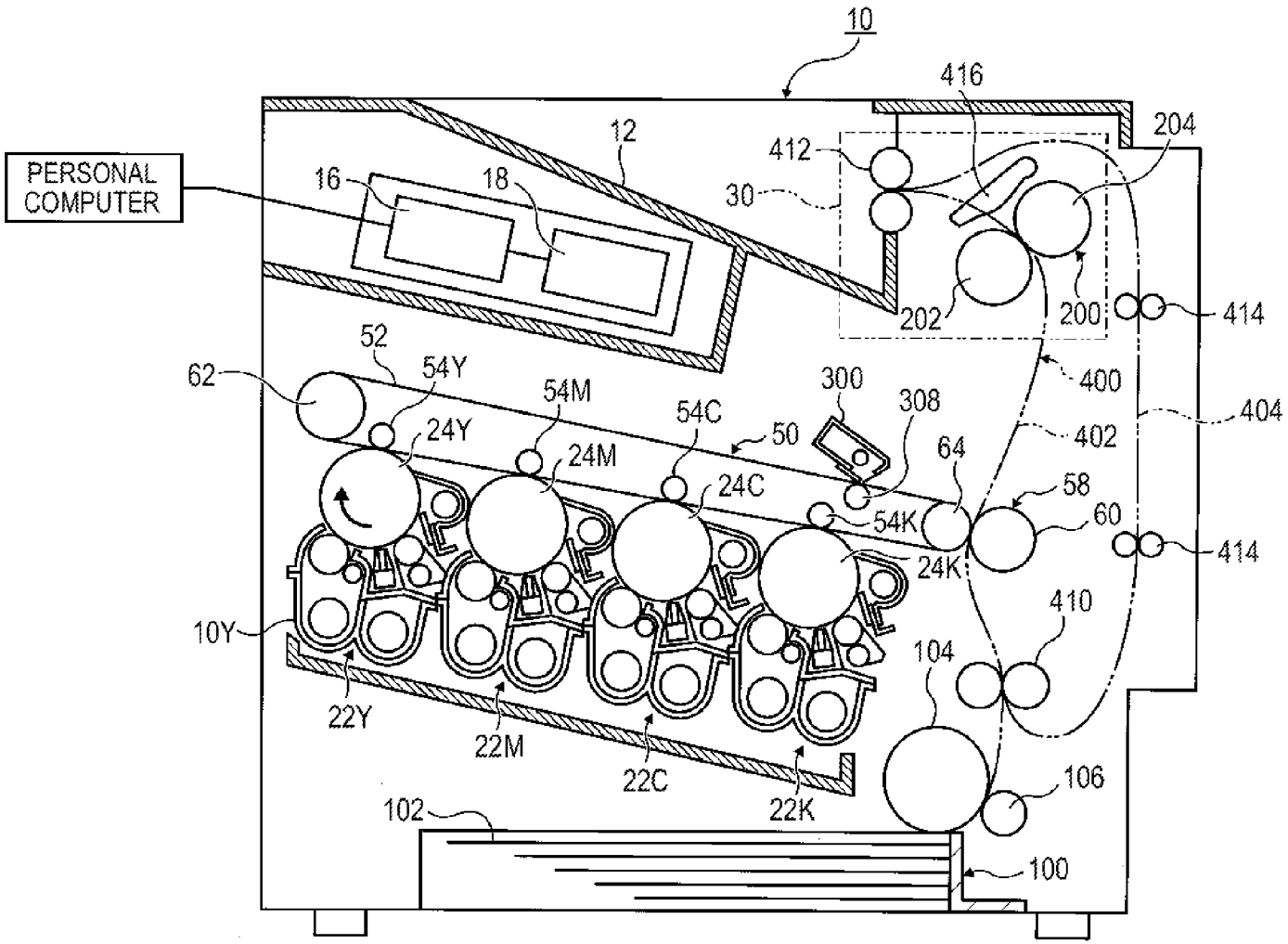
FIG. 1 is a cross-sectional view of an image forming apparatus according to an exemplary embodiment of the invention when the image forming apparatus is seen from the front side.

An image forming apparatus 10 according to an exemplary embodiment of the invention is shown in FIG. 1. As shown in FIG. 1, the image forming apparatus 10 includes an image processing section 16 and a control section 18. The image processing section 16 performs predetermined image processing, such as shading correction, displacement correction, brightness/color space conversion, gamma correction, frame elimination, and color/movement editing, on image data sent from a personal computer (PC), an image reading device (not shown), or the like, as occasion demands. The control section 18 controls the operation of the entire image forming apparatus 10.

Further, the image forming apparatus 10 includes four image forming sections 22Y, 22M, 22C, and 22K, a transfer device 50, a sheet feed device 100, a fixing device 200, and an intermediate transfer body cleaning device 300. Furthermore, a conveying path 400 used to convey a sheet is formed in the image forming apparatus 10, and an upper portion of the image forming apparatus 10 is used as an ejection section 12 to which a sheet on which images have been formed is ejected.

The image forming sections 22Y, 22M, 22C, and 22K include photoconductor drums 24Y, 24M, 24C, and 24K, respectively. The image forming sections form a yellow developer image using yellow developer, form a magenta developer image using magenta developer, form a cyan developer image using cyan developer, and form a black developer image using black developer, respectively. The detail of the image forming sections 22Y, 22M, 22C, and 22K will be described below.

The transfer device 50 includes an intermediate transfer body 52, primary transfer units 54Y, 54M, 54C, and 54K, and a secondary transfer unit 58. The intermediate transfer body 52 is used as a developer carrier that carries developer. In this exemplary embodiment, the intermediate transfer body 52 has the shape of an endless belt and is rotatably supported by plural support rollers 62 and 64. Further, a back-up roller 308, which forms a part of the intermediate transfer body cleaning device 300, is provided inside the intermediate transfer body 52.

At least one of the plural support rollers 62 and 64 is used as a driving roller that transmits a driving force to the intermediate transfer body 52. A driving force generated from a driving source such as a motor (not shown) is transmitted to at least one of the plural support rollers through a drive transmission mechanism (not shown) or the like, and at least one of the plural support rollers is rotated by the transmission of a driving force, and rotates the intermediate transfer body 52. In this exemplary embodiment, the support roller 64 is used as a drive transmission roller. Further, at least one of the plural support rollers 62 and 64 is used as a tension roller that applies tension to the intermediate transfer body 52, and the support roller 62 is used as a tension roller in this exemplary embodiment.

The primary transfer units 54Y, 54M, 54C, and 54K includes primary transfer rollers 56Y, 56M, 56C, and 56K (see FIG. 2) to which a primary transfer bias is applied, respectively. The primary transfer units 54Y, 54M, 54C, and 54K transfer images, which are made of developer and formed on the surfaces of the photoconductor drums 24Y, 24M, 24C, and 24K, to the intermediate transfer body 52.

The secondary transfer unit 58 includes a secondary transfer roller 60. The secondary transfer unit 58 is used as a transfer unit that transfers the developer held by the intermediate transfer body 52 to a sheet.

The fixing device 200 includes a heating roller 202 that heats a sheet, and a pressing roller 204 that presses the sheet against the heating roller 202.

The sheet feed device 100 includes, for example, one sheet storage section 102, a feeding roller 104, and a retard roller 106. The sheet storage section 102 stores sheets, which are used as recording media, while being stacked. The feeding roller 104 feeds the sheets that are stored in the sheet storage section 102. The retard roller 106 prevents the sheets from being fed while the sheets overlap.

The conveying path 400 includes a main conveying path 402 and a reverse conveying path 404. The main conveying path 402 is a conveying path along which a sheet is conveyed to the secondary transfer unit 58 from the sheet feed device 100 and is ejected to the ejection section 12 from the secondary transfer unit 58. The above-mentioned sheet feed device 100, a registration roller 410, the above-mentioned secondary transfer unit 58, the above-mentioned fixing device 200, and an ejection roller 412 are provided in this order along the main conveying path 402 from the upstream side in a sheet conveying direction.

The registration roller 410 temporarily stops the movement of a front end portion of a sheet, which is conveyed to the secondary transfer unit 58, toward the secondary transfer unit 58, and restarts the movement of the front end portion of the sheet toward the secondary transfer unit 58 so as to match the timing where a portion of the intermediate transfer body 52 to which the developer images are transferred reaches the position of the secondary transfer unit 58.

The ejection roller 412 conveys the sheet, to which the developer images have been fixed by the fixing device 200, toward the ejection section 12. Further, the ejection roller 412 is adapted to be capable of being rotated in both directions, that is, a direction where the sheet is ejected to the ejection section 12 and a direction where the sheet is conveyed to the reverse conveying path 404 from the ejection section 12.

The reverse conveying path 404 is a conveying path that is used to reverse a sheet having an image formed on one surface thereof, and the sheet is conveyed along the reverse conveying path 404 from the ejection roller 412 to the upstream side of the registration roller 410. For example, two reverse conveying rollers 414 and 414 are provided along the reverse conveying path 404. Further, a guide member 416, which guides a sheet, is provided between the ejection roller 412 and the fixing device 200. The guide member 416 is adapted to be capable of being moved between a position where the guide member guides a sheet toward the ejection roller 412 from the fixing device 200 and a position where the guide member guides a sheet toward the reverse conveying path 404 from the ejection roller 412.

When an image is to be formed on the other surface of the sheet having an image formed on one surface thereof, the ejection roller 412 is rotated in a reverse direction while the ejection roller 412 comes onto contact with a rear end portion of the sheet on which an image has been formed, the sheet is guided to the reverse conveying path 404 from the rear end thereof by the rotation of the ejection roller 412, and the sheet is conveyed to the registration roller 410.

The intermediate transfer body cleaning device 300 is used as a cleaning device that removes developer from the surface of the intermediate transfer body 52. The intermediate transfer body cleaning device 300 is disposed at an upstream position of the primary transfer unit 54Y, which is positioned on the most upstream side in the moving direction, in the moving direction and on the downstream side of the secondary transfer unit 58 in a moving direction (rotational direction) of the intermediate transfer body 52. The details of the intermediate transfer body cleaning device 300 will be described below.

Figure 2:
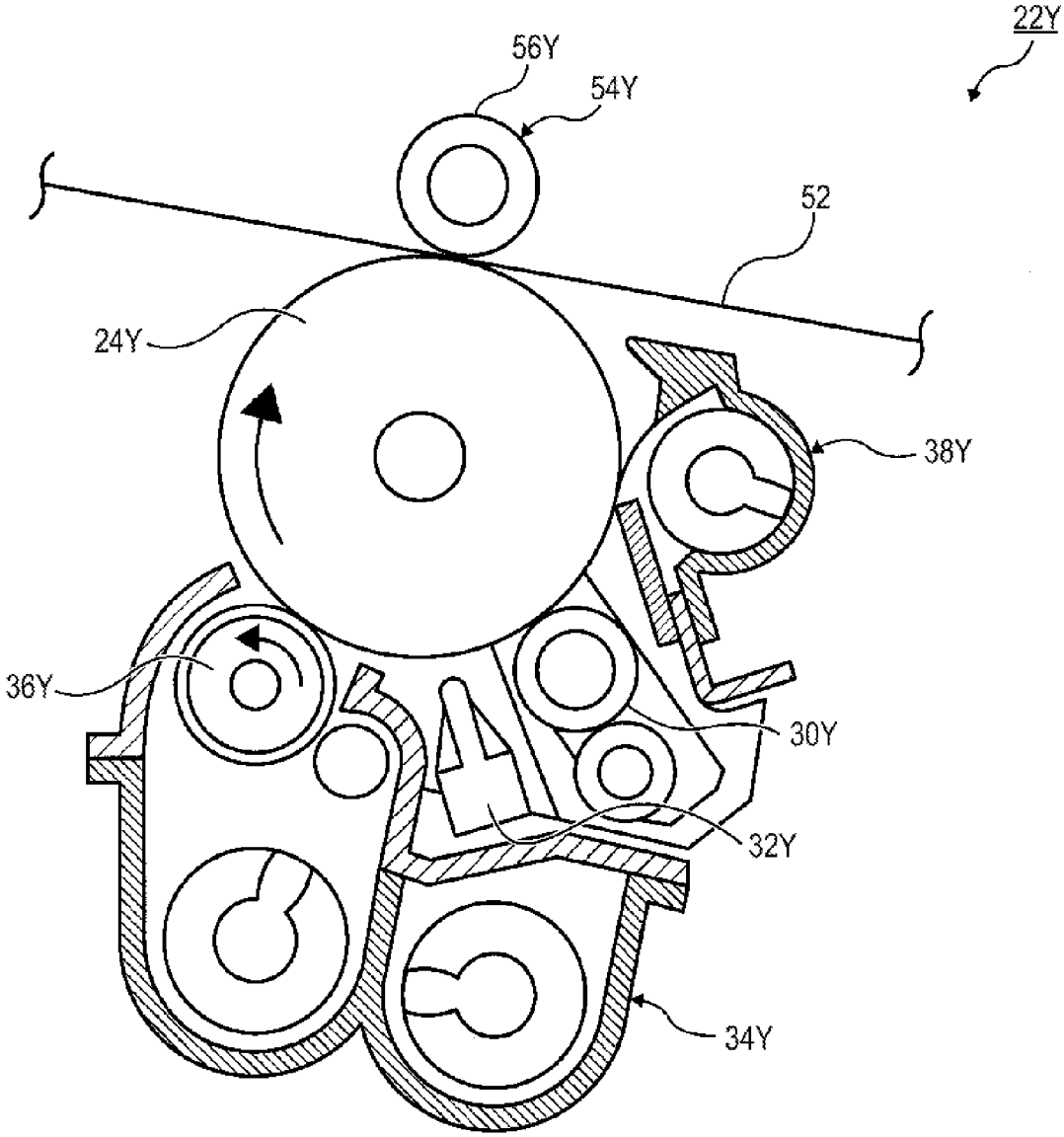
FIG. 2 is a cross-sectional view of an image forming section of the image forming apparatus shown in FIG. 1 when the image forming section is seen from the front side.

The image forming section 22Y is shown in FIG. 2. The colors of the developer used in the image forming sections 22M, 22C, and 22K are different from each other, but the structure of each of the image forming sections 22M, 22C, and 22K is the same as that of the image forming section 22Y to be described below. Accordingly, the description of the structure of the image forming sections 22M, 22C, and 22K will be omitted.

As shown in FIG. 2, the image forming section 22Y includes the above-mentioned photoconductor drum 24Y, a charging unit 30Y, a latent image forming section 32Y, a developing unit 34Y, and a cleaning device 38Y for a photoconductor drum. The charging unit 30Y includes, for example, a charging roller and uniformly charges the surface of the photoconductor drum 24Y. An LED array is used as the latent image forming section 32Y. The latent image forming section 32Y forms a latent image on the surface of the photoconductor drum 24Y by irradiating the surface of the photoconductor drum 24Y, which is uniformly charged by the charging unit 30Y, with light.

The developing unit 34Y includes a developing roller 36Y that is used as a developer carrier. The developing unit 34Y supplies yellow developer to the photoconductor drum 24Y by the developing roller 36Y, and develops the latent image formed on the surface of the photoconductor drum 24Y by the yellow developer. The cleaning device 38Y for a photoconductor drum includes, for example, a plate-like cleaning member, and cleans the photoconductor drum 24Y by scraping off the yellow developer, which remains on the surface of the photoconductor drum 24Y after a yellow developer image is transferred to the intermediate transfer body 52, by the cleaning member.

Figure 3:
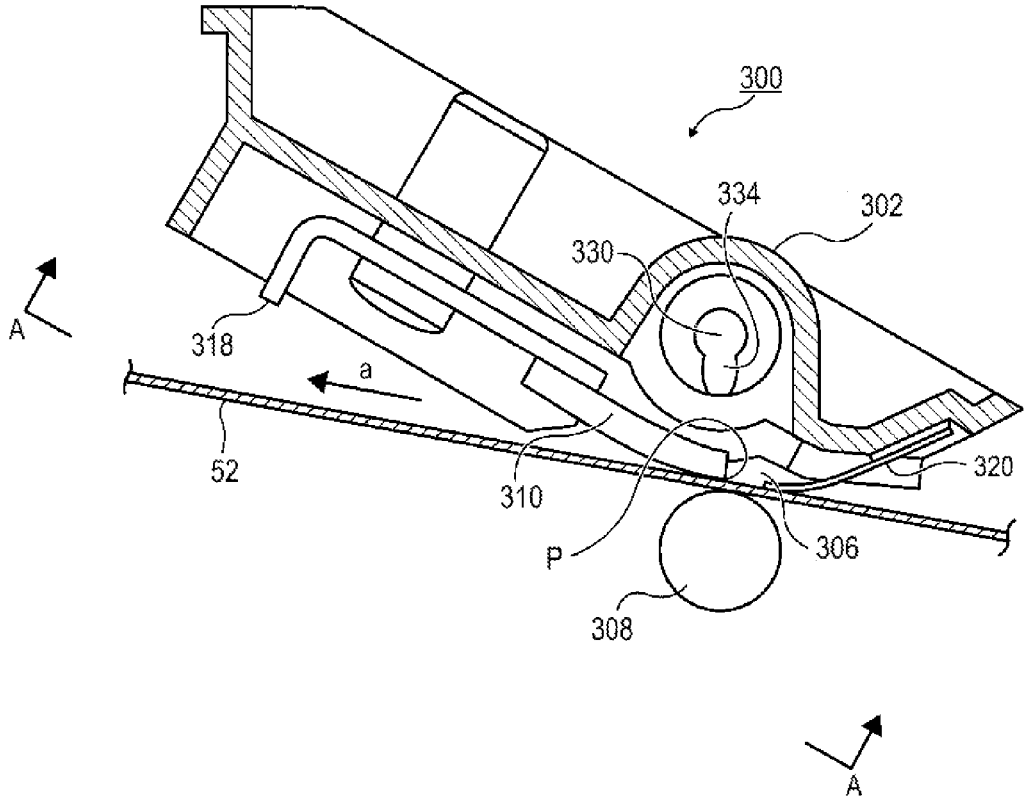
FIG. 3 is a cross-sectional view of an intermediate transfer body cleaning device of the image forming apparatus shown in FIG. 1 when the intermediate transfer body cleaning device is seen from the front side.
Figure 4:
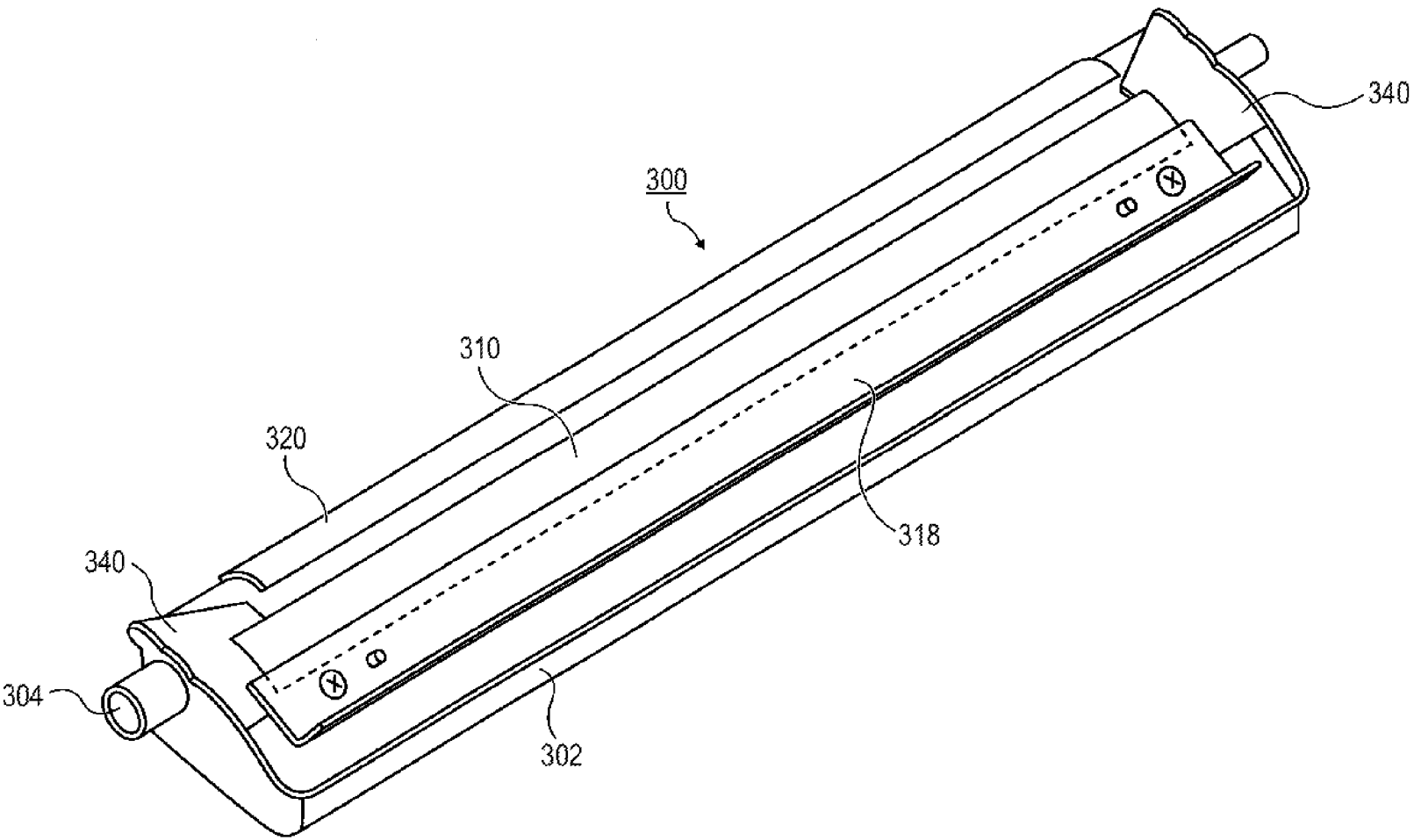
FIG. 4 is a perspective view of the intermediate transfer body cleaning device shown in FIG. 3.
Figure 5:
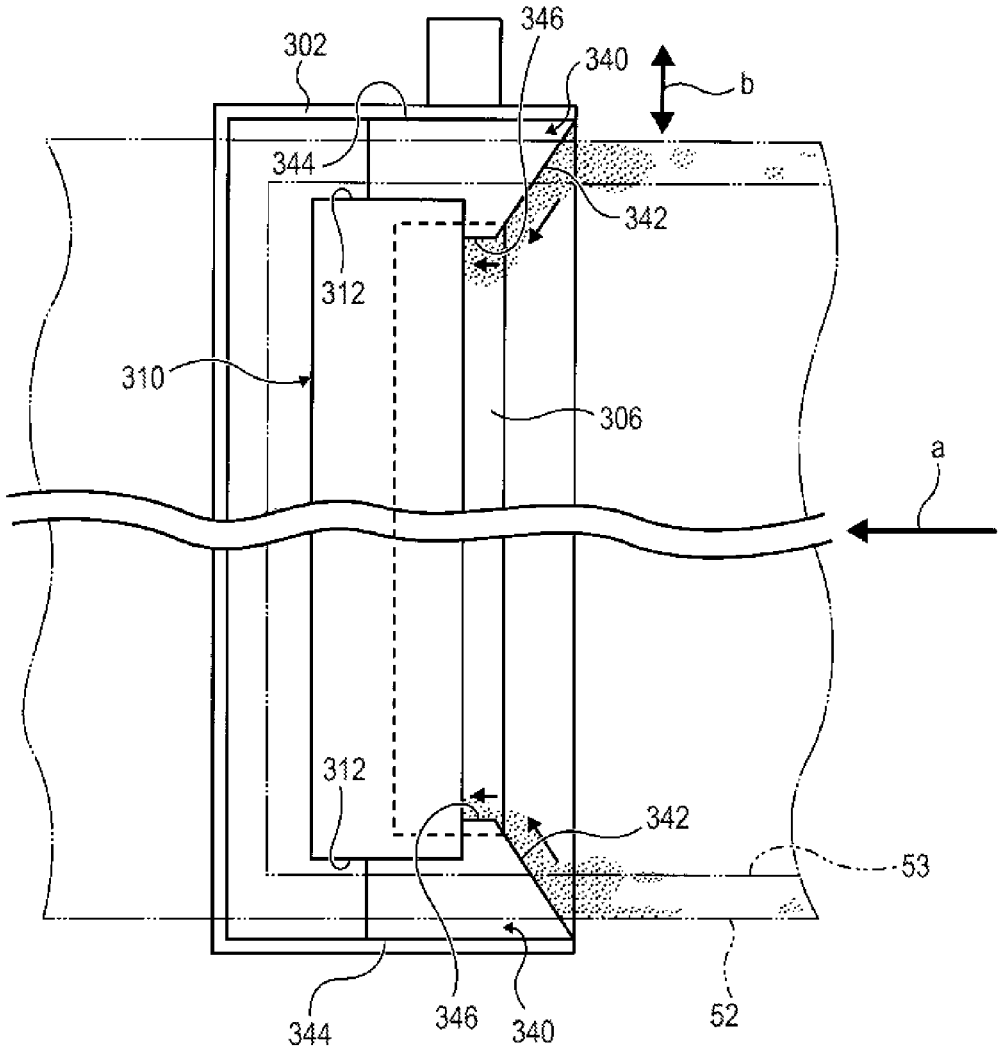
FIG. 5 is a view of the intermediate transfer body cleaning device shown in FIG. 3 when the intermediate transfer body cleaning device is seen in a direction of arrows A-A of FIG. 3.

The intermediate transfer body cleaning device 300 is shown in FIGS. 3, 4, and 5. An arrow "a" shown in FIGS. 3 and 5 represents the moving direction of the intermediate transfer body 52, that is, a direction where the intermediate transfer body is moved to convey the developer held by the intermediate transfer body 52. Further, a region surrounded by a two-dot chain line 53 of FIG. 5 represents an image region on the surface of the intermediate transfer body 52. Here, the image region is a region where developer is held by the intermediate transfer body 52, and is a region to which the developer images are transferred from the photoconductor drums 24Y, 24M, 24C, and 24K when an image is formed. Hereinafter, the region surrounded by the two-dot chain line 53 is referred to as an image region 53. Further, FIG. 5 shows the intermediate transfer body cleaning device 300, from which a support member 318, a seal member 320, and a conveying member 330 to be described below are removed and which is disposed at a position where a cleaning member 310 to be described below is to be mounted.

As shown in FIGS. 3 and 4, the cleaning device 300 includes the above-mentioned back-up roller 308, a recovery section 302 where the developer is recovered, a cleaning member 310, the seal member 320, the conveying member 330, and, for example, two guide members 340.

A discharge hole 304, which is used to discharge developer from the recovery section 302, is formed at the recovery section 302. Further, a recovery port 306, which is used to recover developer, is formed at the recovery section 302.

The cleaning member 310 is used as a cleaning member that comes into contact with the intermediate transfer body 52 in a direction crossing the moving direction of the intermediate transfer body 52 and cleans the intermediate transfer body 52 by removing developer from the intermediate transfer body 52. The cleaning member 310 is made of a flexible material, such as rubber or a resin. One end portion of the cleaning member is supported by, for example, a metal support member 318, so that the cleaning member 310 is mounted on the recovery section 302 by the support member 318. Further, the other end portion of the cleaning member 310 comes into contact with the intermediate transfer body 52 at a contact position P, and the cleaning member 310 is pressed against the back-up roller 308 with the intermediate transfer body 52 interposed therebetween.

For example, a flexible film-like member is used as the seal member 320. The seal member 320 is disposed on the upstream side of the cleaning member 310 in the moving direction of the intermediate transfer body 52, and seals a gap formed between the recovery section 302 and the intermediate transfer body 52 so that the developer scraped off from the surface of the intermediate transfer body 52 by the cleaning member 310 does not leak to the outside of the intermediate transfer body cleaning device 300.

The conveying member 330 is used to convey the developer, which is removed from the intermediate transfer body 52 by the cleaning member 310, to the outside of the recovery section 302. The conveying member 330 includes a spiral blade portion 334. The conveying member 330 is rotatably mounted on the recovery section 302. A driving force is transmitted to the conveying member 330 from a drive transmission mechanism (not shown), so that the conveying member 330 is rotated. Accordingly, the conveying member 330 conveys the developer, which is scraped off by the cleaning member 310, to the outside of the recovery section 302 through the discharge hole 304.

The developer, which is discharged to the outside of the recovery section 302 by the conveying member 330, is recovered by a recovery section (not shown).

The guide members 340 are used as guide members that guide developer to the recovery port 306, and two guide members are provided so as to come into contact with both edge portions of the intermediate transfer body 52. Further, the guide members 340 are positioned on the downstream side of the secondary transfer unit 58 in the moving direction of the intermediate transfer body 52 that is shown by the arrow "a". An upstream end portion of each of the guide member 340 is positioned on the upstream side of an upstream end portion of the cleaning member 310 (see FIG. 1). Furthermore, it is preferable that each of the guide members 340 be made of a material having elasticity and having low friction between the intermediate transfer body 52 and itself while coming into contact with the intermediate transfer body 52, and sponge such as foam may be used as the material of the guide member 340.

The guide members 340 are mounted on the recovery section 302 by, for example, a method using an adhesive. Portions of the guide members opposite to the portions of the guide members, which are mounted on the recovery section 302, come into contact with the end portions of the intermediate transfer body 52. Accordingly, the guide members have a function of sealing the gap between the intermediate transfer body 52 and the recovery section 302. That is, the guide members 340 are used as seal members that seal the gap between the intermediate transfer body 52 and the recovery section 302.

As shown in FIG. 5, each of the guide members 340 has a guide surface 342 that guides developer. The guide surface 342 is inclined with respect to the moving direction of the intermediate transfer body 52 that is shown by the arrow "a". Further, each of the guide members 340 is disposed so that one end 344 of each of the guide members is positioned outside an end portion of the intermediate transfer body and an end portion 312 of the cleaning member 310 and the other end 346 of each of the guide members is positioned inside the cleaning member 310 in the direction crossing the moving direction of the intermediate transfer body 52 shown by the arrow "a". Furthermore, each of the guide members 340 is disposed so that the other end 346 is positioned in the image region 53 in the direction crossing the moving direction of the intermediate transfer body 52 shown by the arrow "a".

Moreover, as shown in FIG. 5, the recovery port 306 is disposed in the image region 53 in the direction crossing the moving direction of the intermediate transfer body 52 shown by the arrow "a".

For example, since the support rollers 62 and 64 (see FIG. 1) are mounted so as to be slightly deviated from the positions parallel to each other, the intermediate transfer body 52 may be moved to, for example, meander in a direction (that is, a direction shown by an arrow "b") crossing the direction shown by the arrow "a" where the intermediate transfer body 52 is moved to convey developer. Even when the intermediate transfer body 52 is moved as described above, the guide members 340 are disposed so that one end 344 of each of the guide members is positioned outside the end portion of the intermediate transfer body and an end portion 312 of the cleaning member 310 and the other end 346 of each of the guide members is positioned inside the cleaning member 310 in the direction crossing the moving direction of the intermediate transfer body 52 shown by the arrow "a".

Further, in order to make the yellow developer image, the magenta developer image, the cyan developer image, and the black developer image overlap each other without deviation on the surface of the intermediate transfer body 52, the image region 53 may be moved in the direction (that is, the direction shown by the arrow "b") crossing the direction shown by the arrow "a" where the intermediate transfer body 52 is moved to convey developer. Even when the image region 53 is moved as described above, the guide members 340 are disposed so that the other ends 346 of the guide members 340 are positioned in the image region 53 in the direction crossing the moving direction of the intermediate transfer body 52 shown by an arrow "a".

According to the image forming apparatus 10 having the above-mentioned structure, when developer is attached to the edge portions of the intermediate transfer body 52 or the periphery of the edge portions, the attached developer is guided to the middle portion of the intermediate transfer body 52 from the end portions of the intermediate transfer body in the direction crossing the moving direction of the intermediate transfer body 52 by the guide surfaces 342 of the guide members 340. Then, the developer, which is guided to the middle portion of the intermediate transfer, is scraped off from the intermediate transfer body 52 by the cleaning member 310. Further, according to the image forming apparatus 10, developer, which is attached to the positions outside the end portions 312 of the cleaning member 310 in the image region 53 of the intermediate transfer body 52, is guided to the inside of the cleaning member 310 in the direction crossing the moving direction of the intermediate transfer body 52 by the guide surfaces 342 of the guide members 340. Furthermore, the guided developer is scraped off from the intermediate transfer body 52 by the cleaning member 310.

As described above, the invention may be applied to image forming apparatuses, such as a copying machine, a facsimile machine, and a printer, and developer removing devices used in, for example, these image forming apparatuses.

The foregoing description of the exemplary embodiments of the invention has been provided for the purpose of illustration and description. It is not intended to be exhaustive or to limit the invention to the precise forms disclosed. Obviously, many modifications and variations will be apparent to practitioners skilled in the art. The embodiments were chosen and described in order to best exemplify the principles of the invention and its practical applications, thereby enabling others skilled in the art to understand the invention for various embodiments and with the various modifications as are suited to the particular use contemplated. It is intended that the scope of the invention is defined by the following claims and their equivalents.

What is claimed is:

1. A cleaning device comprising:

a cleaning member that comes into contact with a developer carrier, which carries developer in an image region on a surface of the developer carrier, in a direction crossing a moving direction of the developer carrier and cleans the developer carrier by removing the developer from the developer carrier;

a recovery section that is provided with a recovery port formed inside of end portions of the developer carrier in the direction crossing the moving direction of the developer carrier and recovers the developer, which is removed by the cleaning member, through the recovery port; and a guide member that guides the developer to the recovery port, one end of the guide member being positioned outside an end portion of the cleaning member and the end portion of the developer carrier, and the other end of the guide member being positioned to overlap the image region on the surface of the developer carrier in the direction crossing the moving direction of the developer carrier.

2. The cleaning device according to claim 1, wherein the recovery port is positioned in the image region in the direction crossing the moving direction of the developer carrier.

3. The cleaning device according to claim 1, wherein the guide member is positioned on an upstream side of the cleaning member and on a downstream side of a transfer device, which transfers the developer held by the developer carrier to a recording medium, in the moving direction of the developer carrier.

4. The cleaning device according to claim 2, wherein the guide member is positioned on an upstream side of the cleaning member and on a downstream side of a transfer device, which transfers the developer held by the developer carrier to a recording medium, in the moving direction of the developer carrier.

5. The cleaning device according to claim 1, wherein the guide member includes a guide surface that guides the developer and is inclined with respect to the moving direction of the developer carrier.

6. The cleaning device according to claim 2, wherein the guide member includes a guide surface that guides the developer and is inclined with respect to the moving direction of the developer carrier.

7. The cleaning device according to claim 1, wherein the guide member doubles as a seal member that seals a gap between the developer carrier and the recovery section.

8. The cleaning device according to claim 1, wherein when the developer carrier is moved in the direction crossing the moving direction of the developer carrier, the one end of the guide member is positioned outside the end portion of the cleaning member and the end portion of the developer carrier, and the other end of the guide member is positioned to overlap the image region on the surface of the developer carrier in the direction crossing the moving direction of the developer carrier.

9. The cleaning device according to claim 1, wherein when the image region is moved in the direction crossing the moving direction of the developer carrier, the other end of the guide member is positioned to overlap the image region in the direction crossing the moving direction of the developer carrier.

10. An image forming apparatus comprising:

a developer carrier that carries developer in an image region on a surface of the developer carrier; and a cleaning device that cleans the developer carrier, wherein the cleaning device includes a cleaning member that comes into contact with the developer carrier in a direction crossing a moving direction of the developer carrier and cleans the developer carrier by removing the developer from the developer carrier, a recovery section that is provided with a recovery port formed inside of end portions of the developer carrier in the direction crossing the moving direction of the developer carrier and recovers the developer, which is removed by the cleaning member, through the recovery port, and a guide member that guides the developer to the recovery port, one end of the guide member being positioned outside an end portion of the cleaning member and the end portion of the developer carrier, and the other end of the guide member being positioned to overlap the image region on the surface of the developer carrier in the direction crossing the moving direction of the developer carrier.

11. A cleaning method comprising:

cleaning, with a cleaning member, a developer carrier by removing developer from the developer carrier which carries the developer in an image region on a surface of the developer carrier, the cleaning member contacting with the developer carrier in a direction crossing a moving direction of the developer carrier;

recovering the developer removed by the cleaning member through a recovery port, the recovery port being formed inside of end portions of the developer carrier in the direction crossing the moving direction of the developer carrier; and guiding the developer to the recovery port with a guide member, one end of the guide member being positioned outside an end portion of the cleaning member and the end portion of the developer carrier, and the other end of the guide member being positioned to overlap the image region on the surface of the developer carrier in the direction crossing the moving direction of the developer carrier.

* * * * *